166-250 SR
FTP8011 OR 4,082,144

United States Patent [19]
Marquis

[11] 4,082,144
[45] Apr. 4, 1978

[54] METHOD AND APPARATUS FOR RUNNING AND RETRIEVING LOGGING INSTRUMENTS IN HIGHLY DEVIATED WELL BORES

[75] Inventor: Gerald L. Marquis, London, England

[73] Assignee: Dresser Industries, Inc., Dallas, Tex.

[21] Appl. No.: 737,748

[22] Filed: Nov. 1, 1976

[51] Int. Cl.[2] ..... E21B 47/00
[52] U.S. Cl. ..... 166/250; 166/77; 166/242
[58] Field of Search ..... 166/250, 77, 242; 175/320; 138/177; 254/134.3 R, 134.4, 134.7; 294/86 CG, 86.12

[56] References Cited

U.S. PATENT DOCUMENTS

| | | | |
|---|---|---|---|
| 3,073,388 | 1/1963 | Chenault | 166/54.5 |
| 3,358,765 | 12/1967 | LeBlanc | 166/54.5 |
| 3,461,978 | 8/1969 | Whittle | 175/27 |

*Primary Examiner*—James A. Leppink
*Attorney, Agent, or Firm*—William E. Johnson, Jr.

[57] ABSTRACT

The system consists of means for running a logging instrument and a long semi-rigid extension on a logging cable through open-ended drill pipe. A head on the upper end of the extension conforms sufficiently close to the inside diameter of the drill pipe that pump pressure down the drill pipe develops thrust across the head to push the extension and logging instrument down the well bore. A catcher sub at the lower end of the drill pipe prevents the extension from being pumped out the bottom of the drill pipe. As the extension and logging instrument are pulled back into the drill pipe by the logging cable, well bore measurements are made and recorded over the interval below the bottom of the drill pipe. The extension consists of a number of sections that are joined together on top of the instrument as the instrument is lowered into the drill pipe on the logging cable, the extension sections each having a slot along their entire length in order that the extension will fit around the logging cable. In one embodiment, the extensions are formed of a threaded steel insert connected to a dissimilar metal, for example, aluminum, by a special welding technique in order to enable the entire extension system to be lighter weight and thus supportable by the logging cable. A cable tension adapter sub at the uppermost top extension causes fluid ports to be rerouted to enable free fluid movement downward through the cable tension adapter sub and restricted movement in the upward direction. This minimizes swab load when logging out of a well.

7 Claims, 28 Drawing Figures

METHOD AND APPARATUS FOR RUNNING AND RETRIEVING LOGGING INSTRUMENTS IN HIGHLY DEVIATED WELL BORES

BACKGROUND OF THE INVENTION

This invention relates generally to a system for logging earth boreholes and specifically to a system which utilizes means to assist a well logging instrument to traverse highly deviated earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes might even extend past 90° from the vertical and actually be extending in the "up" direction for some distance.

It is also well known in the art of drilling such wells to attempt the logging of the formations surrounding such boreholes with logging instruments run into the well bore on a wireline and/or cable to perform various operations. Such tools usually depend upon the force of gravity to permit positioning of the well tools at the desired formation in the well bore.

Manifestly, the relatively horizontal angle of the deviated portion of the well bore will not permit the wireline-actuated tools to move into the lower portion of the well bore since the friction of the well tool in the deviated portion works against the force of gravity. Thus, it has become essential to provide some means of causing the well logging instrument to pass through the deviated portions of the well bore.

Another problem associated with such boreholes relates to the instability of some formations penetrated by the well bore, thus causing borehole diameter changes, some very abrupt. Ledges are formed, and the logging instrument lodges against them.

Furthermore, although there have been attempts in the prior art to pump logging instruments down the borehole, instruments have generaly suffered from the problems associated with having a wireline attached to the instrument, or because of having no correlation between the well logging signals and the true depth in the borehole.

Still another problem associated with attempting to use so-called pumpdown instruments relates to the fact that once the instrument is pumped out the end of the drill pipe, it again is subject to the same problems associated with deviated boreholes, namely, that of having ledges and abrupt changes in the direction of the borehole.

It is therefore the primary object of the present invention to provide a new and improved method and apparatus for logging earth boreholes;

It is also an object of the present invention to provide new and improved method and apparatus for logging highly deviated earth boreholes which allow such instruments for the logging of such earth boreholes to utilize wirelines connected to the earth's surface.

The objects of the invention are accomplished, generally, by a tubular extension apparatus adaptable to be lowered through drill pipe and having a slot along the length of such extension for enabling such extension to be positioned around the wireline from the logging instrument to the earth's surface whereby such extension can be lowered through the drill pipe and out the lower end of the drill pipe to thereby place the logging instrument into position at a desired location within the earth formation beneath the lower end of the drill pipe, and methods for using same.

These and other objects, features and advantages of the present invention will be apparent from the following detailed description taken with reference to the figures of the accompanying drawing, wherein:

FIG. 1 is a schematic view illustrating the drilling of a deviated earth borehole from an offshore platform;

FIG. 2 schematically illustrates a prior art well logging system encountering some of the problems associated with logging a highly deviated earth borehole;

Figure 16:
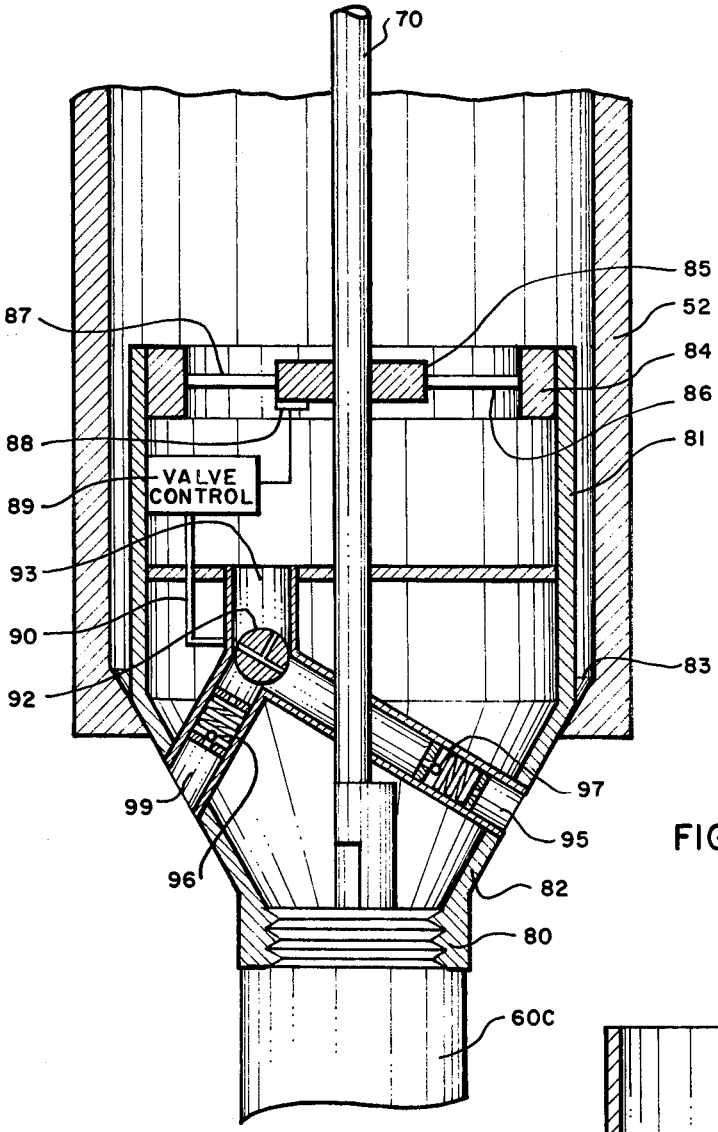
Figure 17:
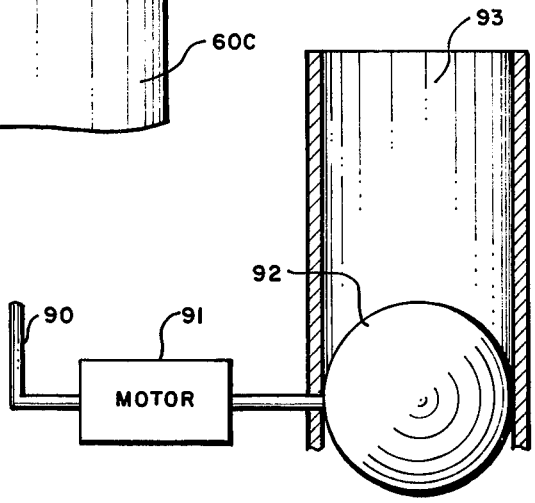
Figure 18:
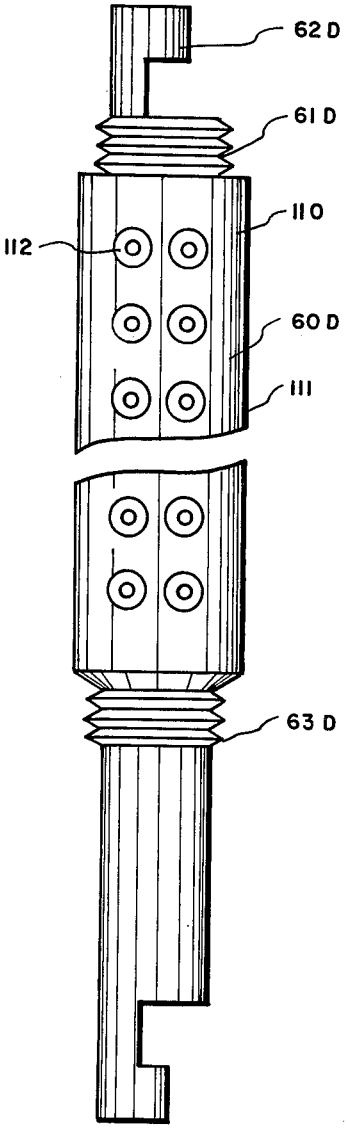
Figure 19:
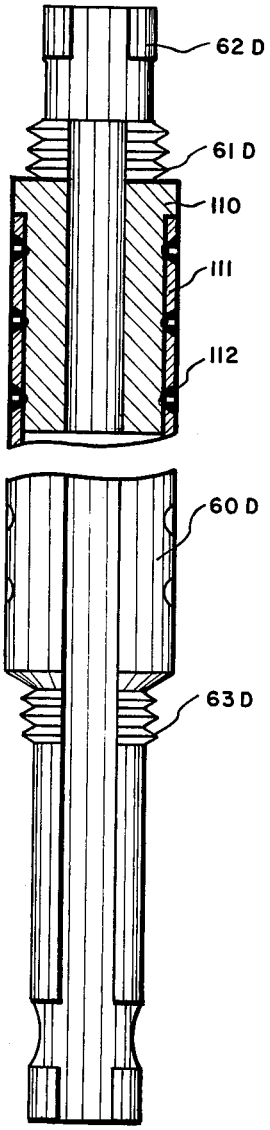
Figure 20:
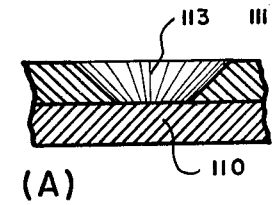
Figure 21:
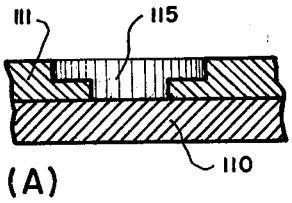

FIG. 16 schematically illustrates, partly in cross section, the circulation sub adapted to be caught by the catcher sub at the lower end of the drill pipe;

FIG. 17 schematically illustrates in greater detail the rotatable ball valve used in the circulation sub illustrated in FIG. 16;

FIG. 18 illustrates an alternative system for fabricating an extension system in accordance with the present invention;

FIG. 19 illustrates, partially in cross section, the extension system of FIG. 18 being rotated 90°;

FIG. 20(A), (B) and (C) schematically illustrate the method of fabricating the extension system illustrated in FIGS. 18 and 19;

FIG. 21(A), (B) and (C) schematically illustrate an alternative method for fabricating the extension system illustrated in FIGS. 18 and 19; and FIG. 22(A), (B) and (C) schematically illustrate an alternative embodiment of a system for fabricating the extension system illustrated in FIGS. 18 and 19.

Figure 1:
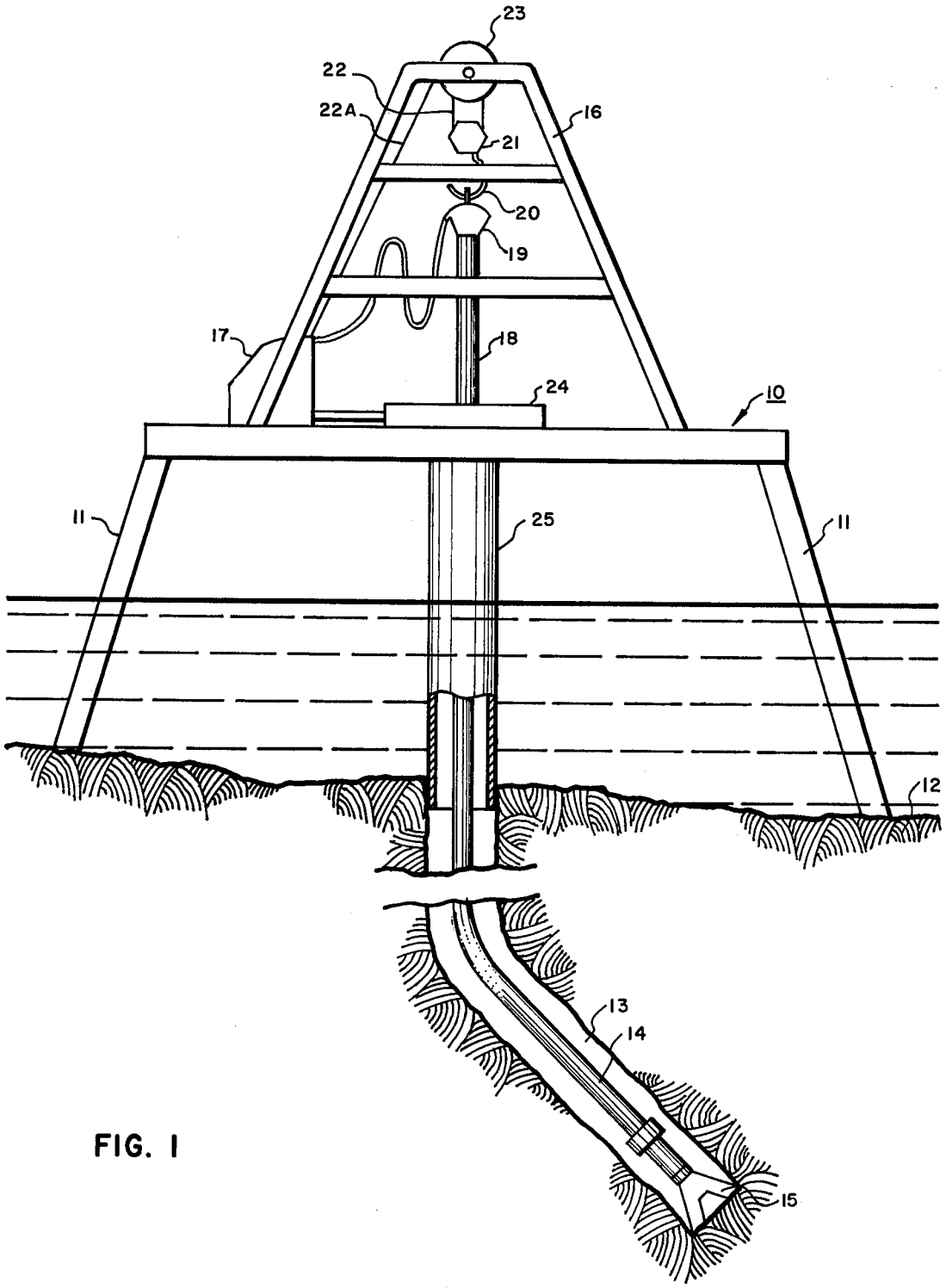

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks 17 also drive a rotary table 24 which in turn transmits the drive to the kelly 18. One end of the line 22, namely the fast line 22*a*, is connected to the drawworks 17 which contains the motor or motors for manipulating the drill string. Although not illustrated, the other end of the drill line 22 is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
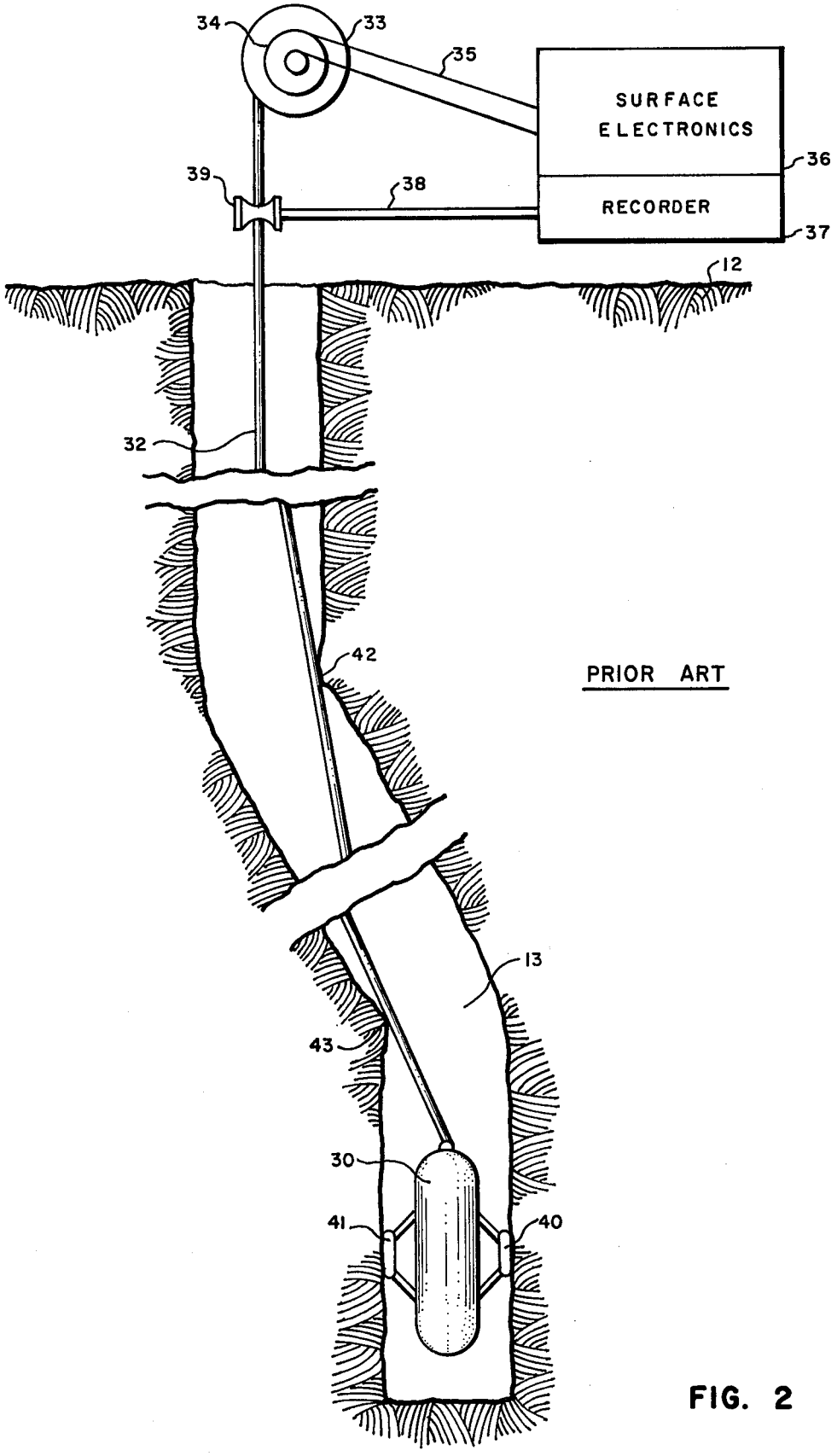

Referring now to FIG. 2, there is illustrated schematically a well logging operation conducted in accordance with the prior art in which a portion of the earth's surface 12 is shown in vertical section. A well 13, which has been drilled as illustrated in FIG. 1, or perhaps from an onshore drilling rig, penetrates the earth's surface. Disposed within the well is subsurface instrument 30 of the well logging system. The subsurface instrument 30 may be of any conventional type, for example, having a neutron source and detector as used in a radioactivity log. Likewise, the instrument 30 could be adapted to conduct an induction, electric, acoustic, or any other of the conventional logs well known in the art. It should be appreciated, moreover, that the particular type of well logging instrument 30 forms no part of the present invention.

Cable 32 suspends the instrument 30 in the well and contains the required conductors for electrically connecting the instrument 30 with the surface electronics. The cable is wound on or unwound from drum 33 in raising and lowering the instrument 30 to traverse the well. During the traversal, the signals from the well logging instrument 30 are sent up the cable 32. Through slip rings and brushes 34 on the end of the drum 33, the signals are conducted by the lines 35 to the surface electronics 36. A recorder 37 connected to the surface electronics 36 is driven through the transmission 38 by the measuring reel 39 over which the cable 32 is drawn, so that the recorder 37 associated with the surface electronics 36 moves in correlation with depth as instrument 30 traverses the well. It is also to be understood that instruments such as the instrument 30 are generally constructed to withstand the pressures and mechanical and thermal abuses encountered in logging a deep well.

As illustrated in FIG. 2, the instrument 30 has a plurality of measuring pads 40 and 41 adapted to engage the borehole walls but, as previously stated, the particular well logging instrument 30 forms no part of the present invention, and any conventional well logging instrument can be utilized as further explained hereinafter.

In the operation of the system illustrated in FIG. 2, the cable 32 is touching one ledge of the formation at the point 42 and another such ledge at the point 43, both of such ledges making it exceedingly difficult for the instrument 30 to traverse the earth borehole merely by its own weight due to the force of gravity. Furthermore, although not illustrated, the instrument 30 itself can easily become lodged against ledges such as the ledge 43 and any further descent becomes nearly impossible.

Figure 3:
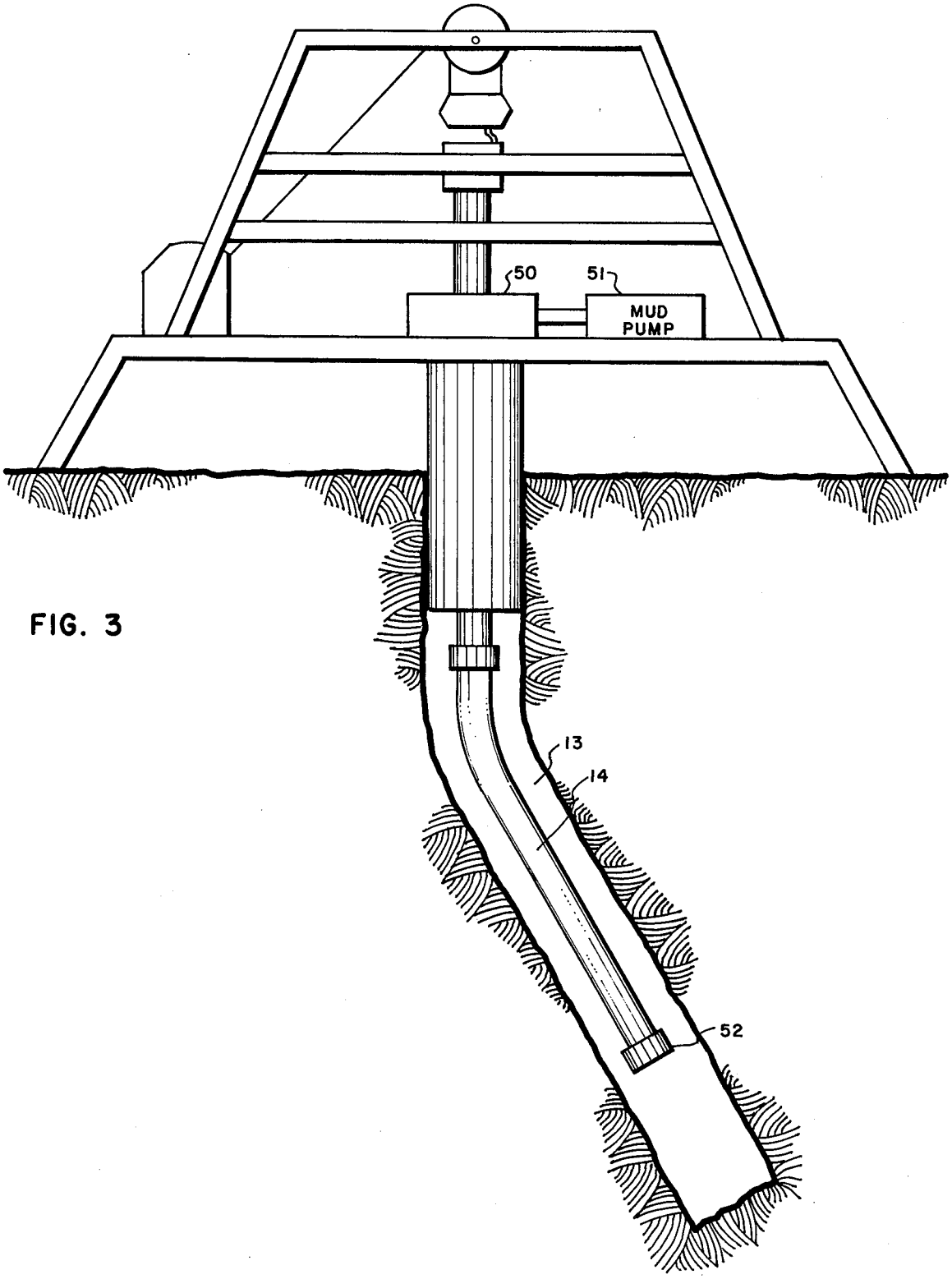
FIG. 3 is an elevated view, partly in cross section, illustrating the utilization of drill pipe lowered into the highly deviated earth borehole prior to lowering the logging instrument into the well bore in accordance with the present invention.

FIG. 3 schematically illustrates, partly in cross section, a similar type rig to that illustrated in FIG. 1 but which might or might not be located on an offshore rig. As contemplated by the present invention, instead of running a conventional well logging instrument down the earth borehole by whatever means as attached to a well logging cable, the present invention contemplates that the instrument will be lowered through the drill pipe 14. Thus, after the drill pipe and drill bit have been removed from the hole, the drill pipe is lowered back into the earth borehole through a blowout preventer 50 to which a conventional mud pump 51 is attached for pumping drilling mud or another such circulation medium down the interior of the drill pipe 14. A catcher sub 52, illustrated in greater detail in FIG. 16, is attached to the lower end of the drill pipe 14. The drill pipe 14 is lowered into the earth borehole 13 at a depth approximately 300 feet above the formation to be logged, the distance above that formation approximating the length of the extension sections to be lowered through the drill pipe as hereinafter explained. For example, if the formation to be logged is at 4,000 feet depth and a 300 feet extension system is used, the lower end of the drill pipe 14 is lowered to a depth of 3,700 feet.

Figure 4:
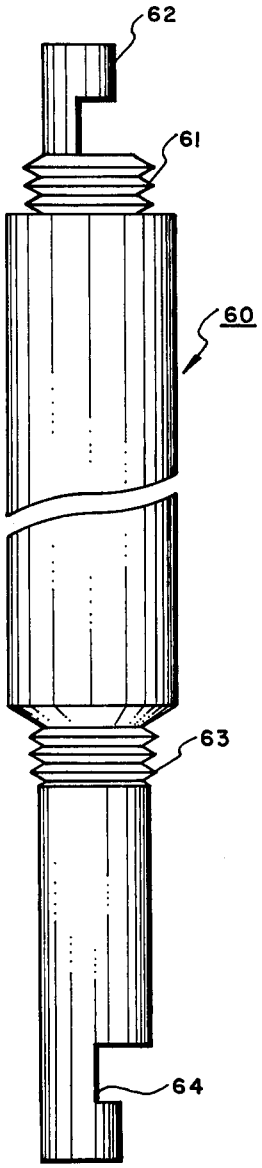
FIG. 4 illustrates the side elevational view of an extension section constructed in accordnace with the present invention.

Referring now to FIG. 4, a side elevational view of one of the extensions constructed in accordance with the present invention is illustrated, the extension being generally shown by the numeral 60. The extension 60 has an upper externally threaded portion 61 and a slotted upper L-shaped extension portion 62. The extension section 60 also has a lower externally threaded portion 63 and a female slot 64 adapted to receive the L-shaped upper portion 62 of the next adjoining extension section.

Figure 5:
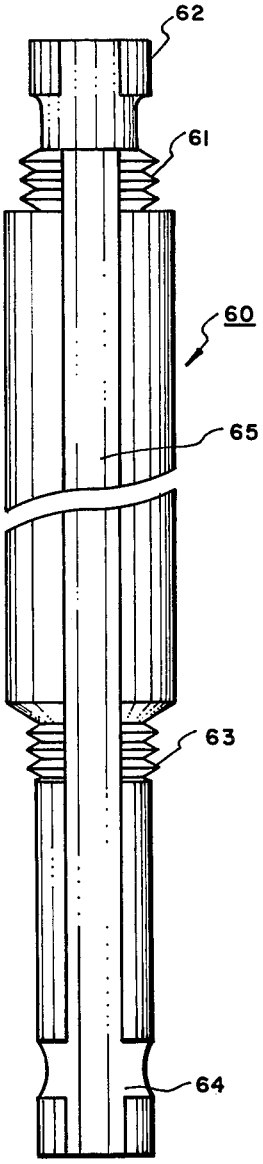
FIG. 5 illustrates the extension section of FIG. 4 rotated 90° around its longitudinal axis.

As illustrated in FIG. 5, the extension section 60 has a slot 65 extending along its entire length adapted to engage the logging cable as hereinafter described.

Figure 6:
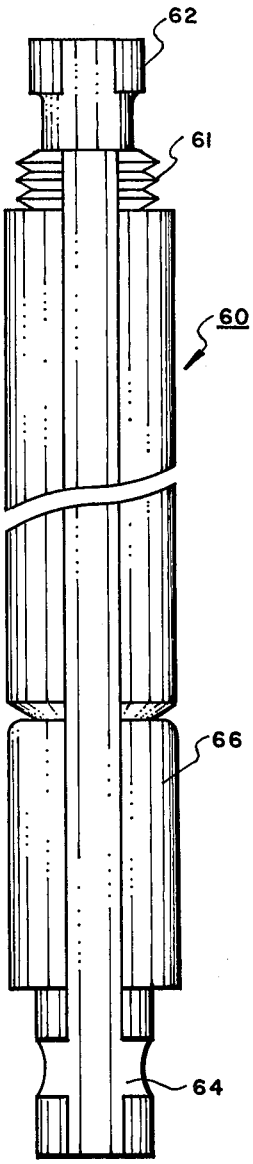
FIG. 6 illustrates an elevational view of the extension sections illustrated in FIGS. 4 and 5 having a split collar screwed onto a lower end of an extension section.
Figure 7:
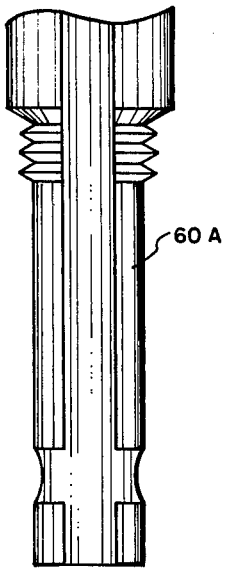
FIG. 7 illustrates the lower portion of the extension section illustrated in FIG. 5.
Figure 11:
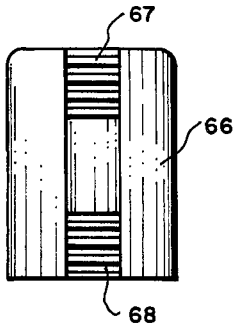
FIG. 11 illustrates an elevated view of a split collar utilized to join the extension sections together.

Referring now to FIG. 6, a split collar 66, illustrated in greater detail in FIG. 11 and having internally threaded portions, is adapted to threadedly engage the externally threaded portion 63 of the extension section 60. When so threadedly engaged, the slot in the split collar coincides with the slot 65 which is found along the entire length of the extension section 60.

Figure 9:
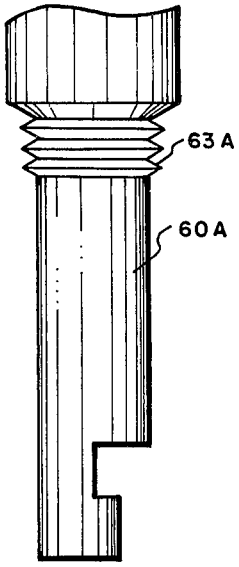
FIG. 9 illustrates the lower portion of the extension section illustrated in FIG. 4.
Figure 8:
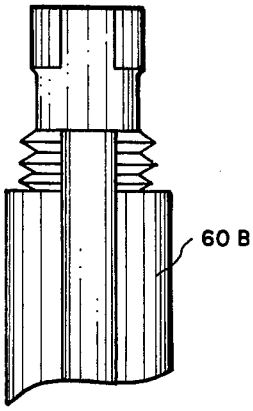
FIG. 8 illustrates the upper portion of the extension section illustrated in FIGS. 5 and 6.
Figure 10:
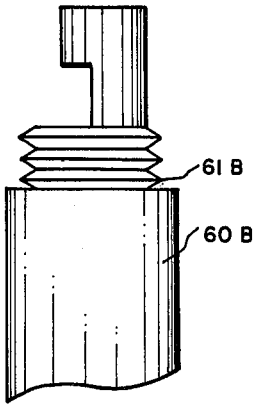
FIG. 10 illustrates the upper portion of the extension section illustrated in FIG. 4 but rotated 180°.

Referring now to FIGS. 7–11, the lower end of one of the extensions 60, shown generally by the numeral 60A, is lined up above the upper end of another one of the extensions 60, shown generally by the numeral 60B in FIG. 8. The extensions 60A and 60B, shown respectively in FIGS. 9 and 10, are 90°-rotated views of the extensions illustrated in FIGS. 7 and 8. The split collar 66 illustrated in FIG. 11 has internally threaded portions 67 and 68, the threaded portion 67 being designed to thread onto the threaded portion 63A of FIG. 9 and the threaded portion 68 of the split collar 66 being designed to screw onto the threaded portion 61B of FIG. 10.

Figure 12:
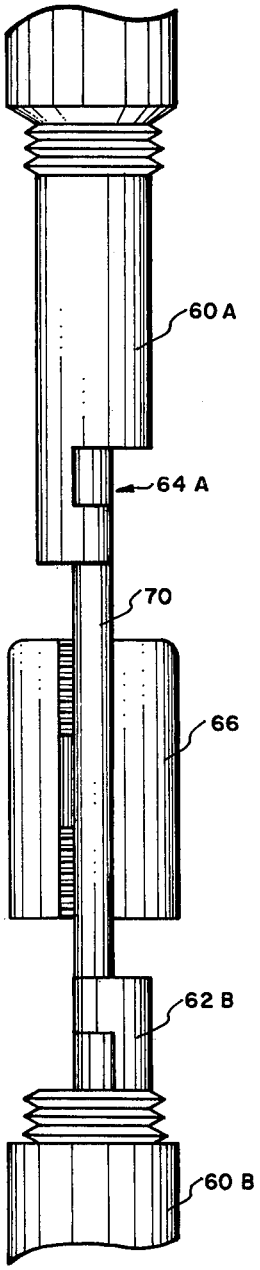
FIG. 12 illustrates the lower end of one of the extension sections engaging a wireline cable and the upper end of one of the extension sections engaging a wireline cable and the engagement of the cable intermediate the extension sections by a split collar.
Figure 13:
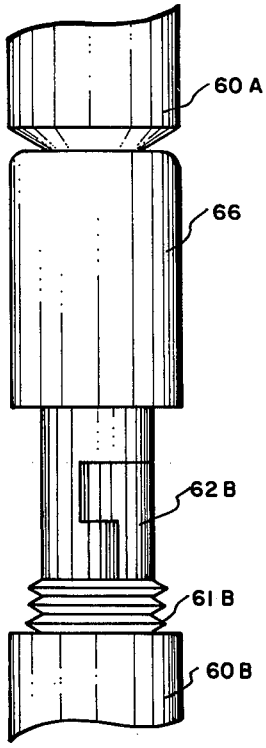
FIG. 13 illustrates the engagement of the two extension sections and the split collar being screwed onto the lower end of the upper extension.

Referring now to FIG. 12, when assembling the extensions 60 around the wireline logging cable 70, it should be appreciated that because of the groove 65 which runs along the length of each of the extensions and also along the length of the split collar 66, the assembly can be made up by placing the extensions 60A and 60B and the split collar 66 around the logging cable 70 and bringing them into a mating position as illustrated in FIG. 13. The upper extended portion 62B of the extension 60B mates into the female slot 64A illustrated in FIG. 12. As this is being accomplished, the split collar 66 is screwed onto the threads 63A to hold the split collar out of the way. After the portions 62B and 64A are mated, the split collar is unscrewed from the thread 63A and screwed down over the threads 61B in a manner which encircles the mating of the portions 62B and 64A, thus completing the joinder of the sections 60A and 60B with the logging cable running through the interior of each.

Figure 15:
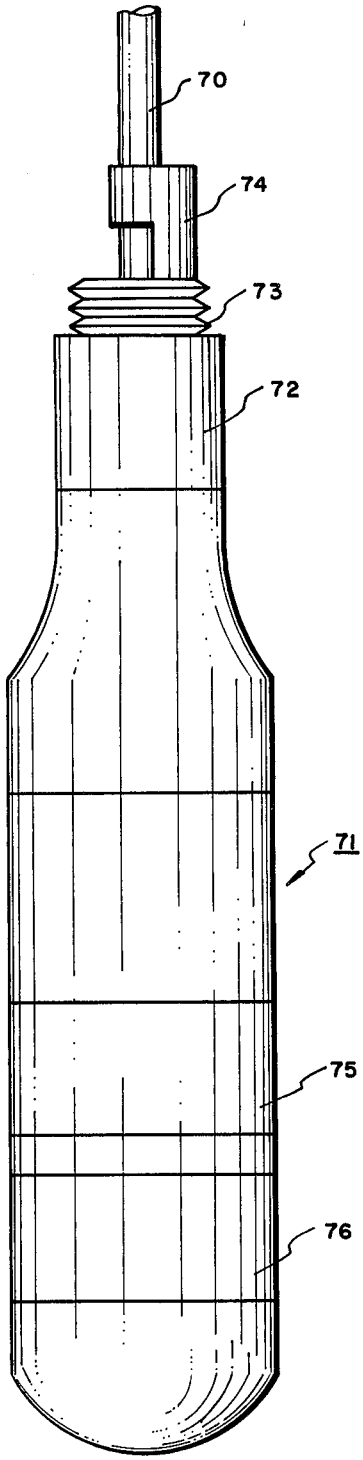
FIG. 15 illustrates a well logging instrument having an upper section adapted to engage the lower end of one of the extension sections in accordance with the present invention.

Referring now to FIG. 15, a well logging instrument 71, being of any conventional type but for convenience sake being illustrated as having a neutron source 76 and a neutron detector 75, has an upper sub 72 with an externally threaded section 73 and upper L-shaped extensions 74 which is fabricated similar to the threaded portion 61 and the upper L-shaped extension 62 illustrated in FIG. 4. The upper sub 72 is connected to the logging cable 70 and makes the necessary distribution of any electrical signals therethrough to the various parts of the logging instrument 71.

Figure 14:
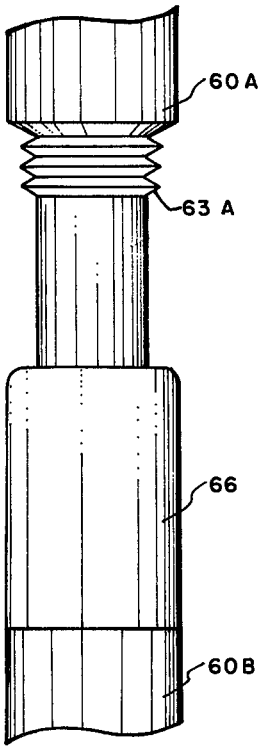
FIG. 14 illustrates the split collar being screwed down over the upper end of the lower extension and encircling the engagement of the two extension sections.

In the operation of the apparatus so far described, it should be appreciated that the logging instrument 71 is first lowered through the blowout preventer 50 illustrated in FIG. 3 and down through the interior of the drill pipe 14. Thereafter, a split collar 66 and an extension 60 is joined to the threaded portion 73 and the upper extended portion 74 in a manner described above with respect to the apparatus illustrated in FIGS. 12–14. As each extension is added, the instrument 71 is lowered further into the drill pipe 14 and eventually, either by gravity or being pumped down, will pass out through the end of the drill pipe 14 and out the end of the catcher sub 52 illustrated in FIG. 3. Depending upon the length and the number of the extensions which are added, the instrument 71 can extend out several hundred feet beneath the lower end of the catcher sub 52.

Referring to FIG. 16, the uppermost extension in the string of extensions which are used to lower the well logging instrument 71 is illustrated generally by the numeral 60C. The upper threaded portion of the extension 60C is threaded into an internally threaded lower portion 80 of a head member 81, the lower end of the head member 81 having inwardly sloping sides 82 which are adapted to fit within the inwardly sloping portion 83 of the catcher sub 52. The head member 81 has an inner ring 84 at its upper end through which fluid can be pumped in a manner hereinafter described. A conventional cable clamp member 85 slides down over the cable 70 while the extensions are being made up and clamped onto the cable 70 at the position indicated within the interior of the ring 84. A pair of shear pins 86 and 87 are locked in place between the ring 84 and the cable clamp 85 to enable the cable 70 to be pulled away from the head member 81 in case it should become stuck within the well bore. A tension sensor 88, for example, a strain gauge, is connected into valve control circuitry 89 which in turn has an electrical conduit 90 connected into a stepping motor 91, illustrated in FIG. 17, which in turn drives a rotatable ball valve 92 having means therein to divert fluid flow coming through the passage 93 depending upon the rotational displacement of the ball valve 92. The passageway 93 divides into a pair of fluid channels 95 and 99 after passing through the ball valve 92. The fluid channel 99 has a spring-loaded check valve 96 which allows fluid to pass only from the exterior of the wall 82 up through the ball valve 92 and the passageway 93 whereas the fluid channel 95 has a spring-loaded check valve 97 biased in the opposite direction such that fluid can pass only from the passageway 93 and down through the ball valve 92 to the exterior of the wall 82.

In the operation of the apparatus illustrated in FIGS. 16 and 17, taken in conjunction with the preceding extension sections made up around the logging cable 70, it should be appreciated that as the extensions and logging instrument pass down through and out the end of the catcher sub, either by gravity or by the operation of the mud pump 51 illustrated in FIG. 3, there will be very little tension on the cable 70 and the ball valve 92 will be rotated around by the stepping motor 91 in a position other than that illustrated in FIG. 16 such that fluid in the borehole can pass up through the channel 99 to facilitate displacement of the fluid in the borehole. Conversely, when pulling the extensions and the instrument out of the borehole, to eliminate or greatly reduce the swabbing problem, tension will be built up in the cable 70 and cause the stepping motor to rotate the ball valve 92 around to the position as illustrated in FIG. 16 and fluid which would normally be swabbed in the upward direction will pass out through the channel 95 into the annulus of the borehole.

Referring now to FIG. 18, an alternative extension section 60D is illustrated which has been constructed of dissimilar metals in order to reduce the weight carried by the logging cable as the extensions are being added. As is well known in the art, it is highly desirable to have the threaded portions constructed of steel or some other such high-strength material to maintain the integrity of the connections between the extensions. However, whenever the extensions are made entirely of steel, the weight becomes a problem because of the entire length of extensions being supported by the logging cable. However, when using dissimilar materials, for example, a steel threaded insert and a length of slotted aluminum between the two steel inserts, an additional problem is created because of the inability to satisfactorily join the two dissimilar materials. As is illustrated in FIGS. 18 and 19, the upper extended portion 62D, the upper threaded portion 61D, and the insert portion 110 are all constructed of steel or some other such strong material. An aluminum collar 111, also having a groove along its entire length as with the previous embodiments, encircles the steel insert 110. A plurality of frusto-conical holes are formed in the lightweight collar 111, for example, aluminum, and a plurality of steel washers having shapes made to conform to these holes are placed within the holes. The washers are generally referred to by the numeral 112.

As is best illustrated in FIG. 20A, B and C, the frusto-conical shaped holes 113 are filled in by the washers 112 which are made of a material which can easily be welded to the steel or other such similar surface 110. As shown specifically in FIG. 20C, the center hole within the washer 112 enables the weld spot 114 to effectively weld the washer 112 to the surface 110. Because of the frusto-conical shape of the hole and the corresponding shape of the washer 112, this wedges the aluminum material 111 against the steel insert 110 in a secure manner.

FIG. 21A, B and C illustrates an alternative method for securing the aluminum collar 111 to the steel insert 110. As shown in FIG. 21A, the hole 115, having a lip portion, is arranged to receive a washer 116 adapted to engage the lip so that when the weld is made between the steel washer 116 and the steel material 110, the aluminum collar 111 is pressed down against the steel surface 110.

Figure 22:
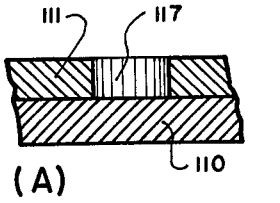

Referring now to FIG. 22, an alternative embodiment is illustrated wherein in FIG. 22A, a hole 117 is formed in the aluminum surface 111 and may be of various shapes, for example, circular, square, or any other desired shape and as shown in FIG. 22B, a washer 118 substantially conforming to the hole 117 is fitted therein. Thereafter, as illustrated in FIG. 22C, the washer 118, being made of steel or some other such similar material, is welded through the center of the washer to the steel plate 110 to thereby attach the aluminum collar 111 to the steel insert 110. Such an embodiment as is illustrated in FIG. 22A, B and C works quite well whenever the lip protruding above the aluminum surface does not act as a detriment to the operation of the extension.

The embodiments of the invention in which an exclusive property or privilege is claimed are defined as follows:

1. A method for logging the formations surrounding an earth borehole, comprising:

attaching a well logging instrument to a well logging cable;

attaching a plurality of tubular extensions to each other end to end, the lower one of said extensions being connected to said instrument, each of said extensions having a slot along its entire length to allow said cable to be placed within said extensions as said extensions are being connected together; and causing said instrument and said plurality of extensions to traverse said borehole and to log at least a portion of the formations surrounding said borehole.

2. A method for logging the formations surrounding an earth borehole, comprising:

running a string of drill pipe within an earth borehole;

attaching a well logging instrument to a well logging cable;

attaching a plurality of tubular extensions to each other end to end, the lower one of said extensions being connected to said instrument, each of said extensions having a slot along its entire length to allow said cable to be placed within said extensions as said extensions are being connected together;

lowering said instrument and said plurality of extensions through said drill pipe until said instrument and at least some of said extensions have passed out through the bottom of said drill pipe; and causing said instrument and said plurality of extensions to traverse said borehole and to log at least a portion of the formations surrounding said borehole.

3. A method for logging the formations surrounding an earth borehole, comprising:

running a string of drill pipe within an earth borehole, the lower end of said drill pipe having a catcher sub attached thereto;

attaching a well logging instrument to a well logging cable;

attaching a plurality of tubular extensions to each other end to end, the lower one of said extensions being connected to said instrument, each of said extensions having a slot along its entire length to allow said cable to be placed within said extensions as said extensions are being connected together, the upper end of the uppermost extension having a head sub with an enlarged section sized larger than the exit opening of said catcher sub;

lowering said instrument and said plurality of extensions through said drill pipe until said head sub engages said catcher sub; and raising said extensions and said instrument to log a portion of the formations surrounding the earth borehole beneath the catcher sub.

4. The method according to claim 3 wherein said instrument and said extensions are lowered by gravity.

5. The method according to claim 3 wherein said instrument and said extensions are lowered by pumping fluid down the drill pipe.

6. A tubular extension member for use in traversing an earth borehole, comprising:

a cylindrical tube having first and second ends, one of its said ends having an L-shaped member and a first external threaded member intermediate said L-shaped member and said tube, the other of said ends having a U-shaped member and a second external threaded member intermediate said U-shaped member and said tube; and a groove extending between the outermost limits of said L-shaped and U-shaped members, through each of said external threaded members, and along the length of said cylindrical tube, whereby said tube can be placed in an encircling manner around a well logging cable.

7. A system for joining together a pair of tubular extension members in accordance with claim 6, being characterized by the L-shaped member of one of said tubular members being mated with the U-shaped member of the other of said tubular members and being further characterized by the addition of a split collar having a groove along its length and internal threads therein to threadedly engage the external threads intermediate the L-shaped member on one of the tubes while encircling said mated L-shaped and U-shaped members.

* * * * *